United States Patent [19]

Doman

[11] Patent Number: 4,736,536

[45] Date of Patent: Apr. 12, 1988

[54] PHOTO IDENTIFICATION DEVICE

[76] Inventor: Henry V. Doman, 2018 N. Waverly, Dearborn, Mich. 48128

[21] Appl. No.: 889,357

[22] Filed: Jul. 25, 1986

[51] Int. Cl.[4] ..... A44C 3/00

[52] U.S. Cl. ..... 40/2 R; 40/158 R; 40/159

[58] Field of Search ..... 40/158 R, 2 R, 159, 40/360; 229/71, 92.3

[56] References Cited

U.S. PATENT DOCUMENTS

| | | | |
|---|---|---|---|
| 1,249,713 | 12/1917 | Blyth | 40/159 |
| 1,340,369 | 5/1920 | Boughton | 40/159 |
| 1,432,036 | 10/1922 | Rand | 40/2 R |
| 1,629,670 | 5/1927 | Malme | 40/159 |
| 2,176,292 | 10/1939 | Brown et al. | 40/159 |
| 2,296,272 | 9/1942 | De Sherbinin | 129/20 |
| 2,505,506 | 4/1950 | Sayre | 129/20 |
| 2,611,369 | 9/1952 | Herrick | 40/159 |
| 3,702,924 | 11/1972 | Wood et al. | 40/158 R |
| 3,924,744 | 12/1975 | Heimann | 40/2 R |
| 3,949,935 | 4/1976 | Stackig | 40/158 R |
| 4,285,683 | 8/1981 | Cross | 493/325 |
| 4,333,254 | 6/1982 | Stevenson | 40/158 |
| 4,366,636 | 1/1983 | Hearsh | 40/159 |

*Primary Examiner*—Robert P. Swiatek
*Assistant Examiner*—Cary E. Stone
*Attorney, Agent, or Firm*—Gifford, Groh, VanOphem, Sheridan, Sprinkle and Dolgorukov

[57] ABSTRACT

A label for identifying the subject matter of a photograph or like item includes an envelope having two portions: a first portion containing identifying indicia and a second portion containing extensions and adhesive for affixing the envelope to said photograph. A longitudinal fold divides the first and second portions so that, in use, the second portion is affixed to the back of a photograph while the first portion lies closely adjacent the front of said photograph but without obscuring the subject of the photograph. Tabs bearing adhesive are disposed at the ends of the first portion and are folded around and attached to the second portion to form a pocket or envelope into which a photograph may be inserted. The device results in a substantially flat identifying label affixed securely to the photograph which may then be viewed, mounted or stored as desired.

16 Claims, 1 Drawing Sheet

PHOTO IDENTIFICATION DEVICE

BACKGROUND OF THE INVENTION

I. Field of the Invention

The present invention relates generally to labels for identifying photographs or like items and, in particular, to an identifying label formed as an envelope into which a photograph is inserted and secured.

II. Description of the Prior Art

Many a photographer has been plagued by the inability, at a later date, to identify precisely the contents of a photograph, the date it was taken or other technical data relating to the photograph. Several systems have previously been used with marginal success to overcome this problem.

Perhaps one of the first identification systems involved anotating the back of a photograph with such identifying material as subject and date. This system worked fine until the photograph was mounted in an album or a frame which caused the identifying data to no longer be visible.

Another previously known system for identifying photographs involves writing the subject and date on the envelope in which the photographs were received from the developer. This system has the disadvantage that photographs are often separated from these envelopes, thus losing the identifying data. In addition, a single roll of film frequently comprises more than one subject matter requiring detailed instructions on a single envelope.

A third alternative for identifying photographs consists of writing identifying data directly onto the page on which the photograph is mounted. U.S. Pat. No. 2,296,272 issued to W. N. De Sherbinin discloses this type of system. An advantage of this system is that the photograph and its identifying data may be simultaneously viewed; however, there are also several disadvantages. First, because the identifying data is written directly on the album page, it is cumbersome to view the photograph and the identifying material at the same time. If the photograph is removed from the album page for easier viewing, it loses its identifying data. Additionally, it is difficult to relocate pictures from one page to another because the identifying data is written directly on the ablum page.

With respect to transparencies, mounting means have been previously known which enable an individual transparency to be identified. U.S. Patent No. 4,333,254 issued to Charles Stevenson discloses such a mounting system for use with dental x-ray films. However, such identifying systems are intended to be permanent mounts for the transparencies and, therefore, have no utility or application with respect to photographic prints. Furthermore, such mounting systems are complex, layered systems which are difficult to use and expensive to manufacture.

SUMMARY OF THE PRESENT INVENTION

The present invention overcomes these and other disadvantages by employing an inexpensive, easily manufactured label which is securely affixed to an individual photograph or like item. The label is manufactured as an envelope a first portion on which the identifying data may be written, and a second portion which contains adhesive means for affixing the label to the photograph. A longitudinal fold separates the first and second portions and tabs attached to one portion fold around the ends of the other portion to form an envelope or pocket having an inside and an outside. Advantageously, the envelope is completely formed by the manufacturer prior to sale to a consumer. The second portion preferably is wider than the first portion and includes at least one extension having a width greater than the remainder of the second portion. Preferably, there are two or more such extensions, one at each end of the second portion or equally spaced, and they contain water soluble adhesive spots for affixing the label to the back of said photograph.

Advantageously, second adhesive spots are disposed on the outside of the second portion of the envelope. If desired, these second adhesive spots may be used to fasten the photograph and label onto a photo album page or other mounting surface.

In use, the label is inscribed on the outside of the first portion with the identifying data, such as subject, date and place. The adhesive spots on the inside of second portion extensions of the envelope are then moistened and a photograh or other item is slipped into the envelope and affixed to said second portion. The first portion containing identifying data then lies closely adjacent the front of the photograph.

It will be realized that the photograph or like item may be inserted into the envelope until it rests upon the longitudinal fold, or it may be inserted only so far as to contact the adhesive disposed on the extensions of the second portion. In the former case, the label will be more securely attached to the photograph but the photograph margin may be obscured by the first portion of the label. On the other hand, in the latter case, the extensions will firmly affix the label to the photograph, yet the first portion of the label will obscure only the second portion and will not obscure any of the photograph.

Finally, it is to be understood that the identifying label of the present invention may be attached to either the long side or the short side of a rectangular photograph or like item , which may then be displayed in either a vertical or horizontal position.

BRIEF DESCRIPTION OF THE DRAWING

A better understanding of the present invention may be had by referring to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
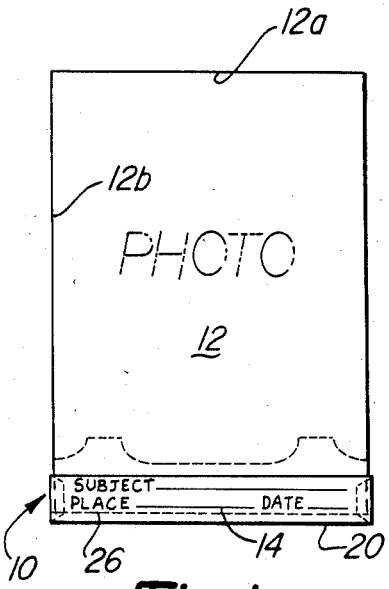
FIG. 1 is a front plan view of the preferred embodiment of the present invention attached to a photograph.

Referring first to FIG. 1 the envelope 10 is thereshown in use with a photograph 12 having a pair of short sides 12*a* and a pair of long sides 12*b*. The envelope 10 comprises a label 14 folded in two at a longitudinal fold 20 and attached to a short side 12*a* of a photograph 12. Identifying indicia 26 appears on the front of label 14, directly below the subject matter of photograph 12. In the ensuing description of the preferred embodiment the envelope 10 is used with a photograph 12. However, it is to be understood that the envelope 10 may also be used to identify the myriad items found in the home or office which are amenable to receiving a flat label, such as files, index cards, checks, invoices, or other papers, for examples.

Figure 2:
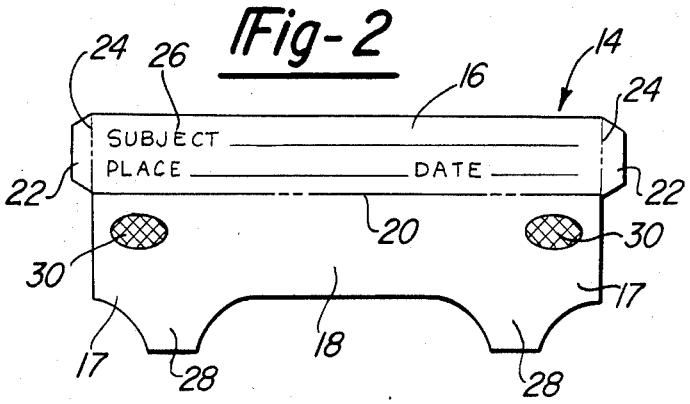
FIG. 2 is a front plan view of the preferred embodiment in its unfolded state.
Figure 3:
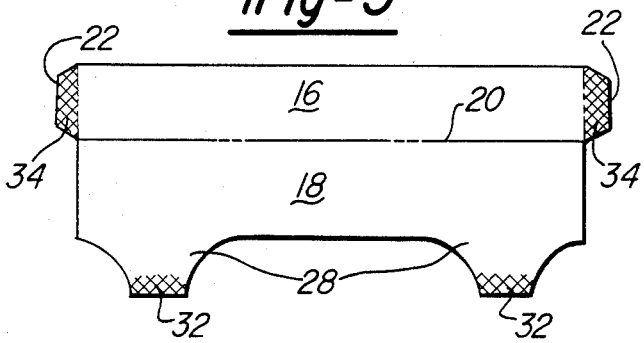
FIG. 3 is a rear plan view of the preferred embodiment of FIG. 2.

Referring now to FIGS. 2 and 3, the preferred embodiment of label 14 is thereshown in its unfolded state. As can be seen from the drawing, the label 14 is a substantially flat body made of bond paper, thin cardboard or plastic, or other like material. The label 14 has a front face as shown in FIG. 2, and a rear face as shown in FIG. 3.

The label 14 comprises two main portions: a first or upper portion 16 and a second or lower portion 18. The two portions 16 and 18 are separated by longitudinal fold 20. The second portion 18 extends away from the longitudinal fold 20 slightly further than the first portion 16 so that the second portion 18 is wider than the first portion 16. In the preferred embodiment, two tabs 22 are attached to the opposing ends of the first portion 16 adjacent the fold 24. The outside of the first portion 16 is capable of being written on and preferably includes identifying indicia 26 such as "Subject", "Place" and "Date". Other indicia 26 may be used if desired and may be printed in any appropriate language so that it can be used in foreign countries.

The second portion 18 is approximately the same length as the first portion 16 excluding tabs 22, but is somewhat wider. At least one extension 28, and preferably two or more such extensions 28, extend from the second portion 18 along the side opposite longitudinal fold 20. The extensions 28 each form a section of the second portion 18 which is wider than the remainder of second portion 18. Opposing ends of the front face of second portion 18 are indicated at 17 and contain adhesive or glue spots 30. If desired, glue spots 30 may be moistened in order to secure the photograph 12 and label 14 to a photo album page or other mounting surface.

Referring now particularly to FIG. 3, the extensions 28 each contain adhesive or glue spots, as indicated at 32, which serve to securely affix label 14 to photograph 12. The tabs 22 also contain adhesive or glue spots 34 which connect the ends of the first and second portions 16, 18 to form the envelope 10 when the label 14 is folded at folds 20 and 24. Thus, the front face of label 14, as shown in FIG. 2, becomes the outside of the envelope 10, while the rear face of FIG. 3 becomes the inside of the envelope 10. Glue spots 32 and 34 may be of the type that becomes tacky when moistened, or of any other suitable type.

Figure 4:
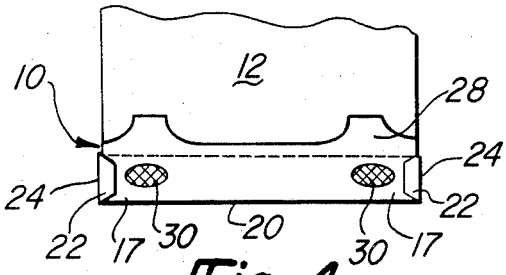
FIG. 4 is a rear plan view of the preferred embodiment of FIG. 1.

Referring now to FIG. 4 the envelope 10 is thereshown in a rear view in its completed form attached to the photograph 12. Tabs 22 have previously been folded at 24 and affixed to ends 17 of second portion 18 and the extensions 28 are shown affixed to the back of the photograph 12. The user need only insert the photograph 12 into the preformed envelope 10.

Figure 5:
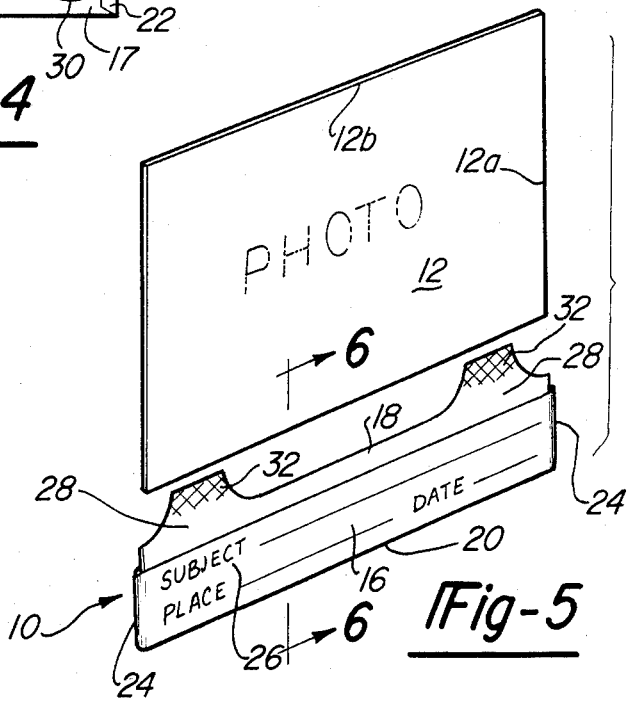
FIG. 5 is an exploded perspective view of the identifying label of the present invention.
Figure 6:
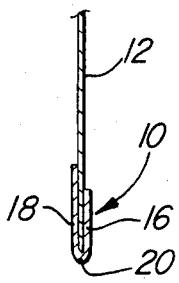
FIG. 6 is an enlarged cross sectional view of the preferred embodiment taken along line 6—6 of FIG. 5.

With reference now to FIGS. 5 and 6, use of the completed envelope 10 is easily understood. Initially, the subject, place and date or other identifying data referring to the photograph 12 are written on the outside of first portion 16 as indicated by indicia 26. Next, the glue spots 32 are moistened to become tacky. The photograph 12 is inserted into the interior of the envelope 10 and is firmly affixed to second portion 18 by the glue spots 32.

It is contemplated that photograph 12 may be inserted into the envelope 10 until it abuts longitudinal fold 20 or, alternatively, it may be inserted only so far as necessary to engage the extensions 28 of the second portion 18. In the first case, as shown in FIG. 6, the photograph 12 will contact essentially the entire width of second portion 18 and will be secured by the glue spots 32, while the first portion 16, when folded flat, will obscure a marginal portion of photograph 12. In the latter case, however, the photograph 12 will contact only extensions 28 and perhaps a marginal part of second portion 18, while the first portion 16 will not obscure any of photograph 12.

It will be understood that the envelope 10 according to the present invention may be used on photograhs or other similar items in either the vertical configuration, as shown in FIG. 1, or in the horizontal configuration, as shown in FIG. 5. The label 14 of the envelope 10 is dimensioned in multiple sizes to fit both the long and short sides 12*b* and 12*a* respectively, of conventionally sized photographs. For example, prints from 35 millimeter film would typically require labels having a length of three and a half and five inches and a width of approximately one half inch, while the $5\times7$ enlargements would typically require lengths of five and seven inches.

Thus, the present invention provides a convenient and inexpensive way to identify the subject matter of photographs or other items. The envelope can easily and inexpensively be manufactured and pre-printed on readily available envelope making and printing equipment. It is advantageous in that the identifying data is affixed directly to the photograph and is readily available if the photograph is passed around for viewing. Nevertheless, the envelope folds flat and may be mounted in a frame or an album. In either case, the identifying data is viewable simultaneously with the front of the photograph and obscures little or none of the photograph itself.

Having described my invention, however, many modifications thereto will become apparent to those skilled in the art to which it pertains without deviation from the spirit of the invention as defined by the scope of the appended claims.

I claim:

1. A device for identifying a photograph or like item having a front and a back, said device comprising:

an envelope having a first portion and a second portion, each of said first and second portions having a width extending outwardly from a common longitudinal fold;

an indicia bearing surface disposed on said first portion; and adhesive means disposed on said second portion for affixing the phtograph to said envelope so that said indicia bearing surface lies closely adjacent the front of said photograph substantially without obscuring said front;

wherein said second portion further comprises at least one extension disposed opposite said longitudinal fold, such that the width of said second portion at said extension exceeds the width of the remainder of the second portion.

2. The identification device according to claim 1, and further comprising tab means disposed at each end of one of said first and second portions, wherein said tab means include adhesive and are folded around and affixed to the other of said first and second portions.

3. The identification device according to claim 1 wherein the width of said second portion exceeds the width of said first portion.

4. The identification device according to claim 1, wherein the width of said second portion at said extension exceeds the width of said first portion lying opposite the longitudinal fold.

5. The identification device according to claim 4, wherein said at least one extension comprises two such extensions disposed near opposing ends of said second portion.

6. The identification device according to claim 4, wherein said adhesive means comprises moistenable glue spots disposed on said at least one extension toward an inside of said envelope, whereby said envelope may be affixed to said photograph by attaching said glue spots to the back of said photograph, while said first portion of the envelope thereby lies adjacent the front of said photograph.

7. The identification device according to claim 6, wherein said second portion of the envelope further comprises second adhesive means disposed on an outside of said envelope.

8. The identification device according to claim 1, wherein said indicia bearing surface comprises a writing surface on which identifying data may be written.

9. The identification device according to claim 8, wherein said indica bearing surface includes indicia for identifying the subject, place and date of said photograph.

10. A device for identifying a photograph or like item having a front and a back, said device comprising:

an envelope having a first portion and a second portion, each of said first and second portions having a width extending outwardly from a common longitudinal fold;

a label having an indicia bearing surface disposed on said first portion;

adhesive means disposed on said second portion for affixing the photograph to said envelope so that said indicia bearing surface lies closely adjacent the front of said photograph substantially without obscuring said front; and tab means disposed at each end of one of said first and second portions, and means for securing said tabs to each end of the other of said first and second portions.

11. The identification device according to claim 10 wherein the width of said second portion exceeds the width of said first portion.

12. The identification device according to claim 10 wherein said second portion further comprises at least one extension disposed opposite said longitudinal fold, such that the width of said second portion at said extension exceeds the width of said first portion lying opposite the longitudinal fold.

13. The identification device according to claim 12 wherein said at least one extension comprises two such extensions disposed near opposing ends of said second portion.

14. The identification device according to claim 12 wherein said adhesive means comprises moistenable glue spots disposed on said at least one extension toward an inside of said envelope, whereby said envelope may be affixed to said photograph by attaching said glue spots to the back of said photograph, while said first portion of the envelope thereby lies adjacent the front of said photograph.

15. The identification device according to claim 14 wherein said second portion of the envelope further comprises a second adhesive means disposed on an outside of said envelope.

16. The identification device according to claim 10 wherein said indicia bearing surface comprises a writing surface on which identifying date may be written.

* * * * *